United States Patent [19]

Violi

[11] Patent Number: 5,058,194

[45] Date of Patent: Oct. 15, 1991

[54] STEAM GENERATOR FOR COOKING APPLIANCES

[75] Inventor: Raymond Violi, Faverges, France

[73] Assignee: Societe Cooperative De Production Bourgeois, Faverges, France

[21] Appl. No.: 292,939

[22] Filed: Jan. 3, 1989

[30] Foreign Application Priority Data

Jan. 8, 1988 [FR] France ..... 88 00513

[51] Int. Cl.[5] ..... F22B 5/02; F22B 1/28

[52] U.S. Cl. ..... 392/400

[58] Field of Search ..... 219/271, 272, 273, 275, 219/341, 401, 440, 320, 321; 392/400, 401, 402, 405, 377, 378

[56] References Cited

U.S. PATENT DOCUMENTS

| | | | |
|---|---|---|---|
| 1,662,935 | 3/1928 | Odell | 392/378 |
| 1,727,585 | 9/1929 | Carleton | 392/401 |
| 1,791,970 | 2/1931 | Odell | 392/400 |
| 2,007,034 | 7/1935 | Bidwell | 392/401 |
| 2,369,623 | 2/1945 | Utley et al. | 219/273 |
| 2,505,170 | 4/1950 | Burnstein et al. | 219/271 |
| 2,571,462 | 10/1951 | Lohman | 392/401 |
| 2,766,366 | 10/1956 | Eckhoff | 392/401 |
| 3,744,474 | 7/1973 | Shaw | 219/401 |
| 4,223,205 | 9/1980 | Sturgis | 392/400 |
| 4,878,458 | 11/1989 | Nelson | 392/400 |
| 4,881,493 | 11/1989 | Riba | 392/400 |

FOREIGN PATENT DOCUMENTS

| | | | |
|---|---|---|---|
| 238955 | 9/1987 | European Pat. Off. . | |
| 3532261 | 9/1987 | Fed. Rep. of Germany . | |
| 8606564 | 10/1987 | Fed. Rep. of Germany . | |
| 2145853 | 1/1973 | France . | |
| 80013 | 2/1919 | Switzerland | 392/401 |
| 442976 | 2/1936 | United Kingdom | 392/400 |
| 2158210 | 11/1985 | United Kingdom . | |

*Primary Examiner*—Geoffrey S. Evans
*Attorney, Agent, or Firm*—Ratner & Prestia

[57] ABSTRACT

A steam generator for cooking appliances, having three vertical tubes connecting a lower duct and an upper duct together. The central tube is a heating tube having an electric resistance welded to the outside of the tube. The second tube is a return tube for returning water from the upper duct to the lower duct. The steam escapes through a discharge orifice in the upper duct. The third tube comprises a resistive probe measuring the level of the water and for regulating it to an intermediate level.

13 Claims, 4 Drawing Sheets

STEAM GENERATOR FOR COOKING APPLIANCES

BACKGROUND OF THE INVENTION

1. Field of the Invention

The present invention relates to devices for producing steam from liquid water, the steam being usable particularly in cooking appliances.

Numerous steam generators are already known which generally comprise an electric resistance immersed in a water reservoir. Supplying the electric resistance with electric energy produces a temperature rise of the water contained in the reservoir, then boiling and the escape of steam from the surface of the liquid.

These devices have the drawback of great inertia: before beginning to produce steam, it is necessary to heat the liquid contained in the reservoir, which requires a relatively long time; from the moment when the steam begins to be produced, if it is desired to stop the production of steam, the power supply to the electric resistance must be cut off; once the electric power supply is cut, the water contained in the reservoir is still at a high temperature and the production of steam continues for some time.

2. Description of the Prior Art

The document DE-A-3 532 261 describes a steam generating device comprising, in the embodiment shown in FIG. 3, a lower reservoir with a water intake device, an upper reservoir with a steam escape orifice and several heating riser tubes sealingly connecting together the two lower and upper reservoirs; a return tube also connects the two reservoirs together. Water level detection and regulation means, comprising a water level probe and a water supply pump, maintain the water level at an intermediate height in the upper reservoir, so that the lower reservoir and the heating tubes are entirely filled with water, as well as about half of the upper reservoir. The device described in this document, which contains a large amount of water, has the same drawbacks of thermal inertia as those mentioned in connection with the plunging resistance devices.

The document EP-A-0 238 955 describes a deep fryer having a structure relatively similar to that of document DE-A-3 532 261, with an upper reserve, a lower reserve, and heating tubes connecting them together. The liquid also fills the lower reserve, the whole of the heating tube and a part of the upper reserve, so that the drawbacks of thermal inertia and steam production are also present in this device.

Such a great inertia does not make it possible to accurately regulate the steam production. The result is that such known steam generators, which may be suitable for the production of saturated steam in large amounts, are no longer suitable when it is desired to regulate accurately the amount of steam produced, e g. for producing non saturated steam in an enclosure under well defined conditions.

Furthermore, known steam generators have the drawback of containing, during their operation, a relatively large amount of water kept at a high temperature. This means that the lime contained in the water furs up all the parts of the device containing water, causing frequent breakdowns. In particular, the lime is deposited in inaccessible positions, difficult to clean and requiring long and expensive de-scaling operations.

SUMMARY OF THE INVENTION

The object of the present invention is in particular to avoid the drawbacks of known generators, by providing a new generator structure having a very low inertia,; with such a generator in accordance with the invention, after a relatively long down time, after which the water is cold, it is possible to begin to obtain steam after a very short heating time; from a condition in which steam is produced, it is possible to stop the production of steam also in a very short time.

Thus, such a device makes possible a very reliable control of steam production, regulation thereof in amount or rate, and it is possible to control the steam production without undergoing considerable delays.

Furthermore, the generator of the present invention makes possible a very high steam flowrate because, with a new structure, the effective contact area between the heating elements and the water is considerably increased. In particular, the steam produced is discharged very rapidly without being re-condensed in contact with the liquid phase, and it is replaced by liquid phase water coming rapidly into contact with the heating elements. The result is that the installed electric resistance power required for obtaining a given flow of steam is considerably reduced with respect to conventional approaches.

According to another object of the invention, since the steam is produced in a heating tube through which the water flows, the invention provides special means for avoiding the discharge of unvaporized water.

According to another object of the invention, the device is very easy to clean and the cleaning is efficient. In particular, the lime contained in the water is deposited in readily accessible and well located places. Furthermore, this lime is deposited in the form of scales which tend to detach themselves naturally from the walls of the device, and to break up in the form of a powder which is deposited at the bottom of the appliance, which powder is removed during emptying. The cleaning operations properly speaking are thus considerably spaced apart and facilitated.

According to another object of the invention, the heating tube may be readily removed for cleaning, or replaced.

According to another object of the invention, the operation of such a generator is particularly silent.

To attain these objects and others, the steam generator of the invention comprises:

a lower transverse duct having a water intake orifice, an upper transverse duct with a steam discharge orifice, disposed above the lower duct, at least one heating riser tube with axial cavity a first end of which is sealingly connected to a first corresponding orifice of the lower duct, and a second end of which is sealingly connected to a first corresponding orifice of the upper duct to ensure the passage of fluid between the lower duct and the upper duct, the heating tube having on its external face a spirally wound electric resistance welded to the heating tube, the electric resistance being connectable to a source of electric energy for heating the tube, a return tube, a first end of which is connected sealingly to a second corresponding orifice of the lower duct and the second end of which is connected sealingly to a second corresponding orifice of the upper duct, the return tube conveying unvaporized steam from the upper duct to the lower duct, means for detecting and regulating the level of the water present in the heating tube, comprising an electrovalve disposed upstream of the intake orifice of the lower duct in the water intake flow direction, the electrovalve closing and opening the duct for intake of water coming from a water supply source, the electrovalve being controlled by a control assembly connected to the water level detection means for: causing opening of the valve after the probe has indicated that the water level in the heating tube is less than a predetermined low intermediate level in the heating tube, and causing closure of the valve when the water level in the heating tube is greater than a predetermined high intermediate level in the heating tube, so that the steam produced in the heating tube escapes directly into the upper transverse duct and the steam discharge orifice, without passing through the liquid layer, and so that the liquid phase water projected out of the tube flows into the return tube.

In an advantageous embodiment, the heating tube is connected to the lower and upper ducts by flexible tubular connections, without direct contact between the heating tube and the ducts, so that the heating tube is removable and the seals provide sound proofing.

In an advantageous embodiment, the upper duct and the lower duct are substantially horizontal and disposed one above the other, the heating tube is rectilinear and substantially vertical, the return tube is rectilinear and substantially vertical.

Preferably, the means for detecting and regulating the water level comprise a third tube connecting the upper duct and the lower duct together, the third tube containing an axial resistive probe for measuring the level of the water in the third tube, the probe being disposed above the intermediate high level of the water so as to be in contact with the water when the level thereof reaches or exceeds the intermediate high level, so that the probe produces an electric detection signal when the water level becomes higher than the high intermediate level, the electric detection signal being fed to a valve control timing circuit which produces an opening signal after a given delay T and maintains the valve open for the intake of water until the detection signal appears. With this arrangement, accurate regulation of the water level is possible, maintaining this level at a substantially constant height. The inventors have unexpectedly discovered that such accurate regulation of the water level, associated with the fact that the level is maintained in the vicinity of or slightly below the upper limit of the spiral resistance portion makes it possible to efficiently control the lime deposits: these deposits occur in the upper portion of the heating tubes, and in the upper transverse duct, to the exclusion of the other parts of the device. The result is that the lime deposits tend to detach themselves readily and to be transformed into a powder which is deposited in the bottom of the device and is naturally removed during emptying.

BRIEF DESCRIPTION OF THE DRAWINGS

Other objects, features and advantages of the present invention will be clear from the following description of particular embodiments, with reference to the accompanying drawings in which.

DESCRIPTION OF THE PREFERRED EMBODIMENT

Figure 1:
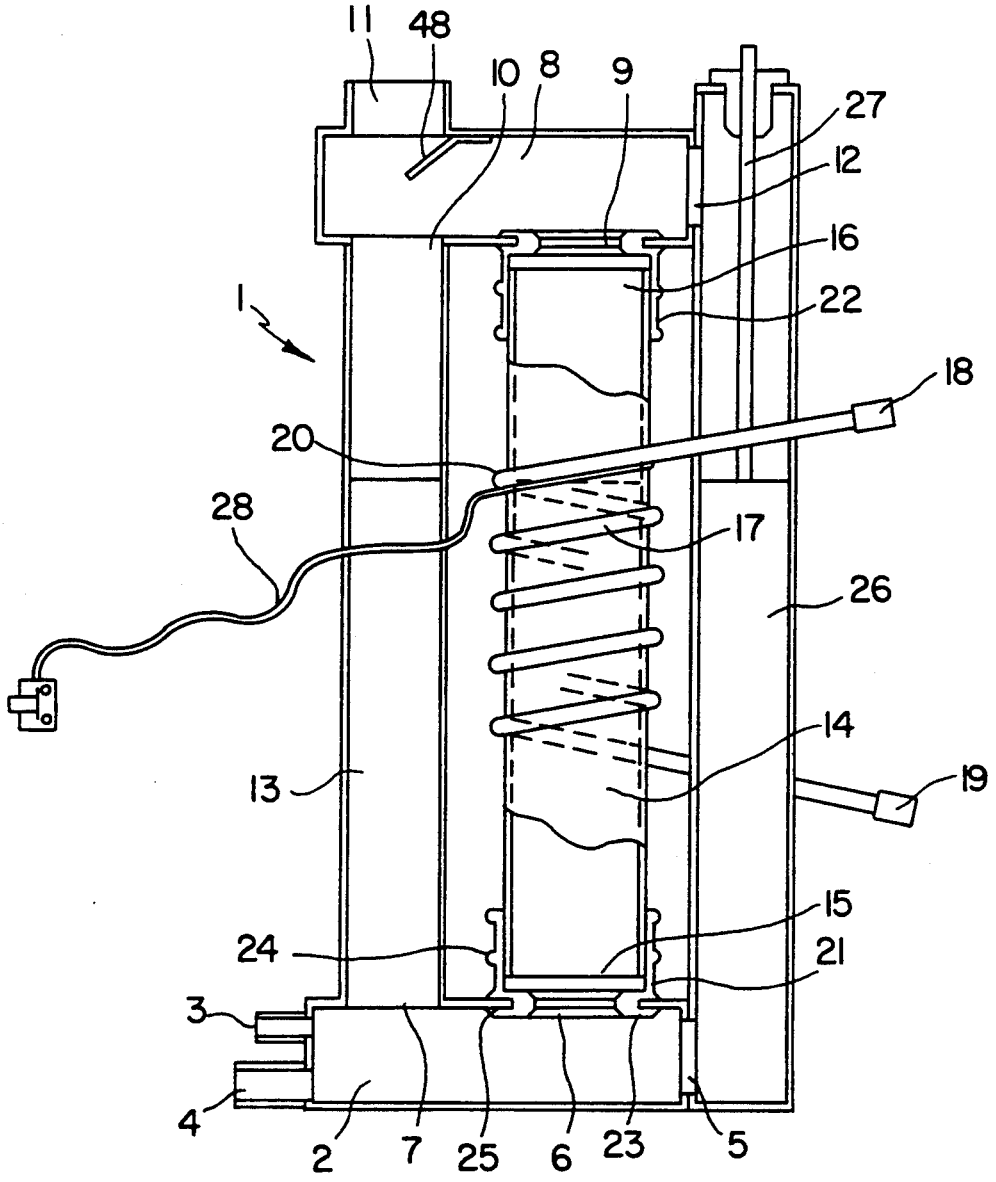
FIG. 1 is a sectional side view of a steam generator of the present invention.

In the embodiment shown in FIG. 1, the steam generator 1 of the invention comprises a lower duct 2 in the form of a substantially horizontal tube, a first end of which comprises a water intake orifice 3 and an emptying orifice 4, the second end of which comprises a passage orifice 5 and the upper wall of which comprises a first orifice 6 and a second orifice 7.

An upper duct 8, having a tubular structure similar to that of the first duct 2, is disposed in a substantially horizontal position above the first duct 2. It comprises, in a lower wall, a first orifice 9 corresponding to the first orifice 6 of the lower duct, and a second orifice 10 corresponding to the second orifice 7 of the lower duct. On the upper face, and opposite the second orifice 10, the upper duct 8 comprises a steam discharge orifice 11. Thus, the steam discharge orifice 11 is offset laterally with respect to the first orifice 9 to produce a baffle effect. At the end opposite the discharge orifice 11, the upper duct comprises a passage orifice 12.

A return tube 13 places the second orifice 7 of the lower duct and the second orifice 10 of the upper duct in communication. In the embodiment shown, the return tube 13 is made from metal like the lower duct 2 and the upper duct 8, the return tube 13 being welded to both ducts so as to form a hollow one-piece assembly.

A metal heating tube 14, with axial cavity, places the first orifice 6 of the lower duct 2 and the first orifice 9 of the upper duct 8 in communication. The first end 15 of the cavity of the heating tube 14 is sealingly connected to the first orifice 6 of the lower duct, and the second cavity end 16 of the heating tube 14 is sealingly connected to the first orifice 9 of the upper duct 8. The heating tube 14 has, on its external face, an electric resistance 17 wound in a spiral and welded to the heating tube, the electric resistance having two output terminals 18, 19 connectable to a source of electric energy for heating tube 14. The spiral part of the electric resistance 17 occupies the middle zone of the heating tube 14, as shown in the figure n the embodiment shown, the spiral part of the resistance occupies substantially the zone between the lower quarter of the tube and the upper quarter of the tube.

The upper end 20 of the zone occupied by the spiral portion of resistance 17 defines a remarkable position along the tube, which position will be used as explained further on.

The sealed connection between the cavity ends 15, 16 of the heating tube 14 and the lower 2 and upper 8 ducts is provided by means of appropriate tubular flexible connections. Such appropriate tubular connections 21 and 22 have been shown in FIG. 1 in section. The tubular connections 21 and 22 are identical and are made from a relatively flexible material for fitting and removing the heating tube 14 between the lower 2 and upper 8 ducts. A material should be used which withstands the temperature of the tube, which may slightly exceed 100° C. Tubular connections may for example be used made from anthracite alimentary silicon of type 1 C 61 HT. Such a connection structure may withstand a temperature of 315° C.

Each connection such as connection 21 is shaped so as to fit, by a first portion 23, into the corresponding orifice such as orifice 6 of the lower duct 2; a second portion 24 of the connection is shaped as a sleeve which fits on to the heating tube 14. The first portion 23 of the connection comprises an external annular groove 25 into which is inserted the edge of the corresponding orifice 6 of the upper or lower duct.

The generator further comprises means for detecting and regulating the level of the water in the heating tube 14. In the embodiment shown, the detection and regulation means comprise a third hollow tube 26, placing the passage orifice 5 of the lower duct 2 and the passage orifice 12 of the upper duct 8 in communication. For example, the third tube 26 is a rectilinear tube, like tubes 14 and 13, and parallel to them. The third tube 26 comprises an axial resistive inner probe 27, of known type, for detecting the water level in the third tube 26.

A thermal probe 28 is disposed for measuring the temperature of the heating tube 14 in the zone occupied by the spiral portion of the resistance 17. Preferably, the thermal probe measures the temperature of the tube 14 in the vicinity of the upper end 20 of the spiral portion of electric resistance 17. Associated with measurement and control means, the thermal probe 28 provides thermal safety, causing the electric supply to resistance 17 to be cut off when the temperature measured is greater than a given threshold, which occurs for example should there be an absence of water or a lack of water in tube 14. The given threshold, or maximum admissible temperature TM of the tube is chosen greater than the normal operating temperature of the tube, i.e. the temperature of the tube when the water is boiling in its inner cavity.

Figure 2:
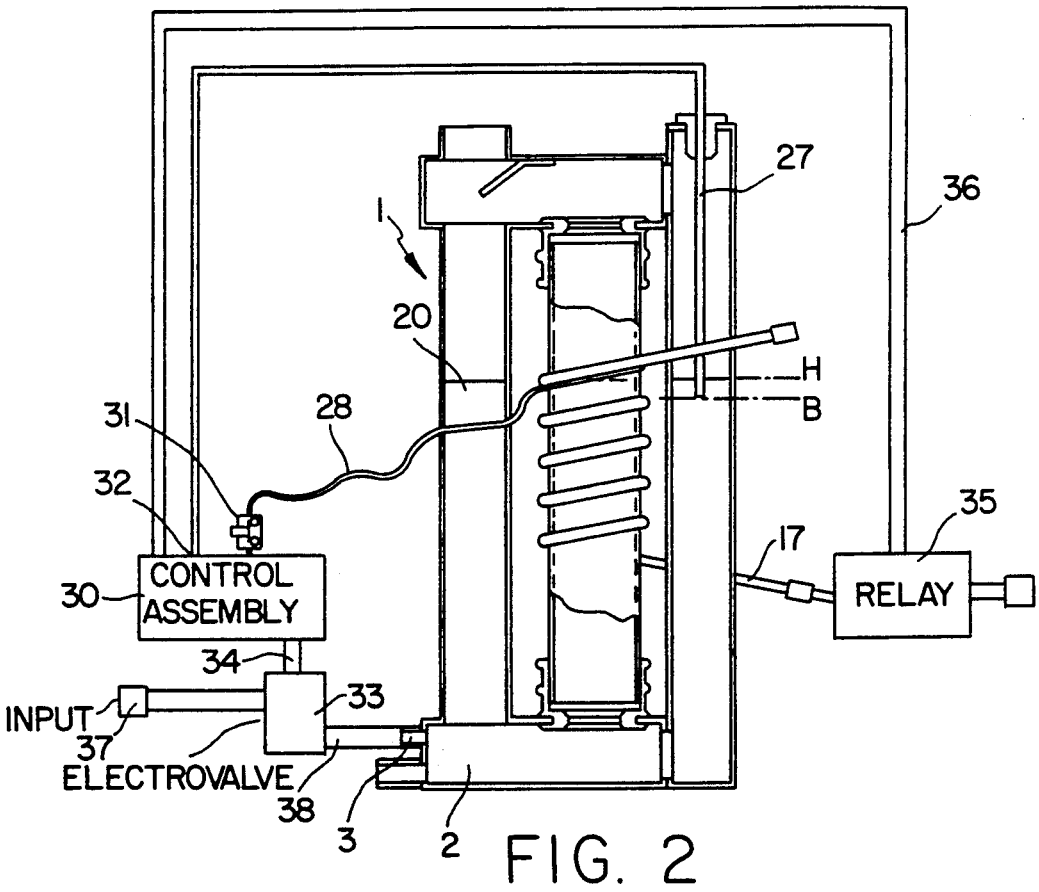
FIG. 2 shows the generator of FIG. 1 with its control means.

In FIG. 2 the steam generator 1 has been shown with its control and regulation elements The control and regulation assembly 30, shown schematically, receives the information both from the thermal probe 28 and from the resistive probe 27, respectively through the two inputs 31 and 32. The control assembly 30 generates, as a function of the input information, output signals fed to an electrovalve 33 over a control line 34 and to a relay 35 or equivalent over a control line 36. The electrovalve 33 is disposed upstream of the intake orifice 3 of the lower duct 2, in the intake water flow direction. The input 37 of electrovalve 33 may be connected for this purpose to a water intake duct and its output 38 is connected to the water intake orifice 3. The control assembly 30 controls the electrovalve for closing and opening the duct admitting water from a water supply source. In a first embodiment shown in FIG. 3, the control takes place as follows:

the signal generated by the control assembly 30 over its control line 34 controls the opening of electrovalve 33 when probe 27 indicates that the water level is less than a predetermined low intermediate level B in the heating tube 14;

the signal generated by the control assembly 30 over its control line 34 controls the closure of the electrovalve 33 when probe 27 indicates that the water level present in the heating tube is greater than a predetermined high intermediate level H. Preferably, the intermediate levels B and H are close to one another and are in the vicinity of the upper limit 20 of the spiral portion of resistance 17 or slightly below.

Relay 35 is connected for closing and opening the electric supply circuit for the electric resistance 17 as a function of the signals present on the control line 36. For that, the control assembly 30 orders the opening of relay 35 and so the cut-off of the power supply to resistance 17, when the temperature probe 28 indicates that the temperature of the heating tube 14 exceeds a predetermined maximum temperature.

Figure 3:
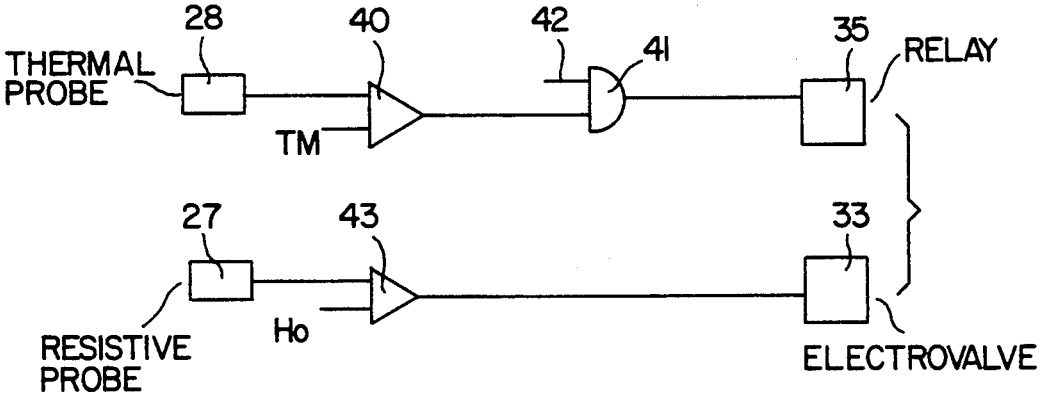
FIG. 3 shows the general electric diagram of the means for controlling the steam generator in one embodiment of the invention.

FIG. 3 gives a structural example of the control assembly 30. A comparator 40 compares the information given by probe 28 with a reference TM representing the maximum admissible temperature. The output of comparator 40 is connected to a first input of an AND flip-flop 41 whose second input 42 receives the external orders for starting and stopping the generator. The presence of a signal at input 42 allows the production of steam and the absence of a signal causes interruption of steam production. The output of flip-flop 41 controls the relay 35. Thus, relay 35 is closed when a signal is present at the input 42 for controlling the steam production and when the temperature probe 28 indicates that the temperature of tube 14 is less than the maximum admissible temperature TM; when a signal is absent from the input 42, or when the temperature exceeds the admissible temperature, relay 35 switches to the open position.

In the second part of FIG. 3, one embodiment has been shown for the water level regulation means, A hysteresis comparator 43 compares the information communicated by the resistive probe 27 and the reference information Ho. The output of comparator 43 controls the electrovalve 33. The electrovalve 33 switches to the open position when probe 27 indicates that the water height is less than the height Ho corresponding to the low mark B, and valve 33 switches to the closed position when probe 27 indicates that the water height is greater than or equal to the height Ho corresponding to the high mark H.

Figure 6:
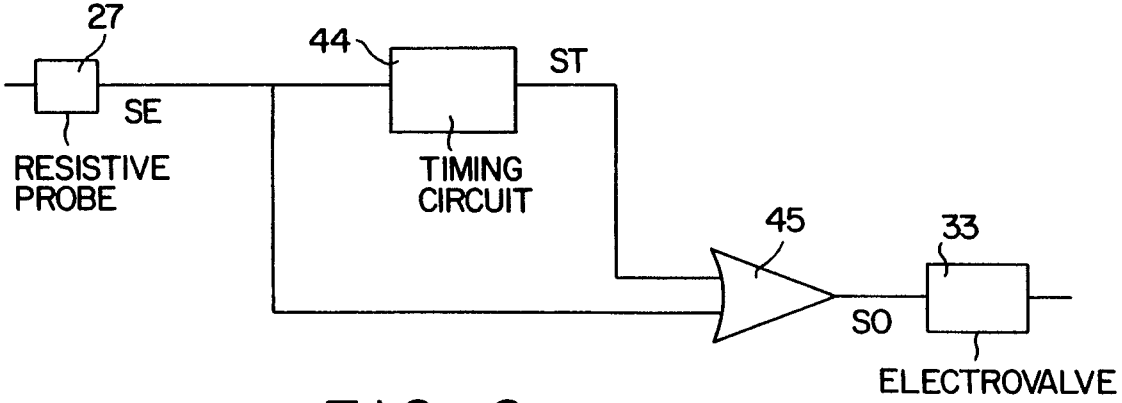
FIG. 6 illustrates a variant of the means for controlling and regulating the water level.

In FIG. 6 a second embodiment has been shown of the means for regulating the water level, so as to obtain accurate regulation well adapted to the aim sought in the present invention. In this embodiment probe 27 is disposed above the high intermediate level H of the water so as to be in contact with the water when the level thereof reaches or exceeds said high intermediate level. The resistive probe 27 produces an electric detection signal SE when the water level becomes greater than the high intermediate level H. The electric detection signal SE is fed to the control assembly 30 which, in this case, is a timed electronic circuit, comprising a timing circuit 44 which receives the electric detection signal SE and which produces a timing signal ST sent to a NOR gate 45. The timing circuit 44 is such that it produces at its output terminal a timing signal ST as soon as a falling edge of the detection signal SE is received, the timing signal ST having a predetermined duration, e.g. about 3 to 4 seconds. The NOR gate 45 receives the detection signal SE at its other input and produces at its output an opening signal SO for controlling the electrovalve 33. Thus, when the water level becomes less than the high level H following boiling, the electronic circuit produces an opening signal SO causing opening of the valve, after a delay T determined by the timing circuit 44, the valve remaining open for the intake of water until the detection signal SE appears again.

Figure 4:
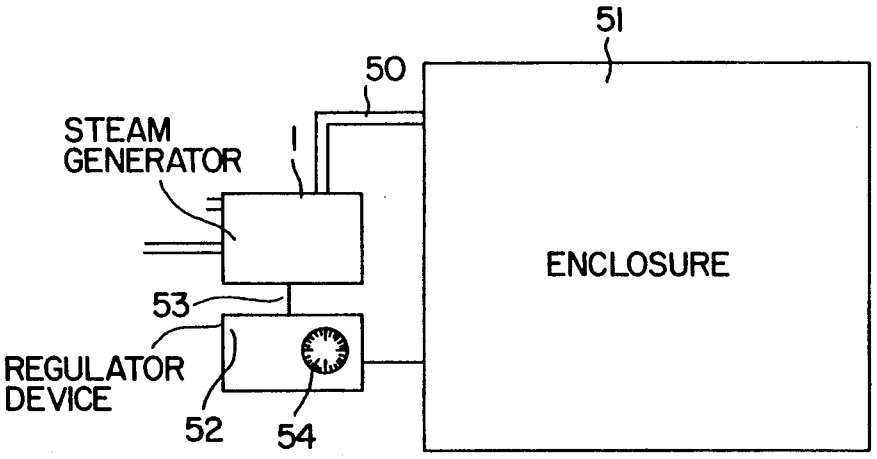
FIG. 4 shows a steam generator of the invention associated with a cooking oven.

In FIG. 4 the generator 1 has been shown producing steam in an outlet duct 50 which conveys the steam produced into an enclosure 51 such as a culinary oven cooking enclosure. A regulation device 52 produces at its output 53 a control signal fed to the steam generator 1, this control signal being fed to input 42 shown in FIG. 3. The regulation device 52 comprises for example a timer with an adjustment knob 54, by which the user may control the cyclic steam production ratio, i.e. the ratio between the on times and the off times of the steam generator 1.

Alternately, the regulation device 52 may comprise a probe producing a signal depending on the condition of the atmosphere in the enclosure 51, this signal being processed by the regulation device for producing signals at output 53 controlling the production and stopping of production of steam by the steam generator 1. Thus, the steam inside enclosure 51 may be maintained in a given condition.

The operation of the device is the following. By operating the electrovalve 33, an intermediate and substantially constant water level is maintained in the heating tube 14. By supplying resistance 17 with power, the heating tube 14 is heated as well as the water which it contains. The water present inside the heating tube 14 heats up very rapidly so that steam is produced almost instantaneously as soon as resistance 17 is fed with power. Due to the boiling, there occurs projections of liquid water which escapes through the heating tube and penetrates through the first orifice 9 into the upper duct 8. The projected and non vaporized water is separated from the steam in the upper duct 8 and flows into the return tube 13. The lateral offset between the steam generator escape orifice 11 and the first orifice 9, producing a baffle effect, prevents the liquid water projections from passing through the steam discharge orifice 11. The steam produced in the heating tube 14 escapes directly into the upper transverse duct 8 and the steam discharge orifice 11, without passing through the liquid layer. The baffle effect is increased by a deflector 48 as shown.

For cleaning the heating tube, the device is emptied of the residual water, a de-scaling liquid such as vinegar is introduced therein so as to completely fill the two tubes and at least a part of the upper duct 8. This operation takes place preferably after a period of operation of the device. It is left to act for a few minutes when cold. It is again drained to remove the vinegar, and it is filled with water up to the upper duct 8. Then the electric resistance 17 is fed with power for heating, the water then begins to flow, and tends to rise in the heating tube 14 and to move down through the return tube 13 and possibly through the third tube 26. The flow considerably improves cleaning and rinsing. Then the residual liquid obtained is drained off.

Because of the arrangement of the rising tubes with fixed intermediate water level, the heaviest lime deposits take place at the top of the heating tube 14, in the zone where the transformation of water into steam takes place. The result is that the steam generator of the present invention has less scaling up problems than conventional boilers. On the other hand, it proves necessary to fill the generator completely during cleaning.

The resistive probe 27 disposed inside tube 26 is naturally outside the lime deposit zones. In fact, the third tube 26 is shunted between the upper 8 and lower 2 ducts, and it may in particular be disposed in two different ways: a first way, shown in FIGS. 1 and 2, consists in connecting the third tube 26 directly to the upper 8 and lower 2 ducts. A second way, shown in the FIG. 5, consists in using a third tube 26 of shorter length, connected to the return tube 13 at two points situated respectively above and below the high water level H. It will be readily understood that the third tube 26, in one and other of the arrangements, contains water at a relatively low temperature, in practice tepid water, since there exists no continuous flow of hot water from the heating tube 14 to the return tube 13 or to the third tube 26. The upper duct 8 forms a good separation between the heating tube 14 and the third tube 26. Such separation is further accentuated by the presence of the flexible tubular connections 21 and 22 which oppose heating of the upper 8 and lower 2 ducts by thermal conduction between the heating tube 14 and said ducts.

In a practical embodiment, adapted for the production of steam for a professional spit roaster or a culinary oven, heating tubes 14 may be used sold under the trademark EGOTHERM by the German firm EGO ELEKTRO-GERATE. Tubes of a diameter of about 40 mm and a length of about 200 mm may be suitable, with an electric resistance 17 of 2 or 4 kW.

With such a generator, starting from an inactive cold condition, it is possible to obtain steam after a very short waiting time of about 15 to 20 seconds. When the heating tube 14 is still hot after a period of interruption of the steam, it is possible to obtain steam again practically instantaneously. The production of steam ceases practically instantaneously as soon as the power supply to the electric resistance 17 is interrupted.

Because of the low inertia of the generator, it is possible to accurately regulate steam injection and stopping of steam production depending on the different cooling modes. It is thus possible to control the steam production and to associate it with an adjustable timer. Thus, it is possible, depending on the foods to be cooked, to regulate very accurately the amount of steam required at a temperature close to 100° Celsius, in the enclosure 51 of an oven.

The presence of the flexible tubular connections 21 and 22 considerably reduces the noise through the boiling of the water in the heating tube 14 during operation. The result is that the operation of this generator of the invention is considerably more silent than conventional boilers. This arrangement further participates in eliminating lime deposits, by promoting the breakage and detachment of the scale at the upper part of the heating tubes.

Figure 5:
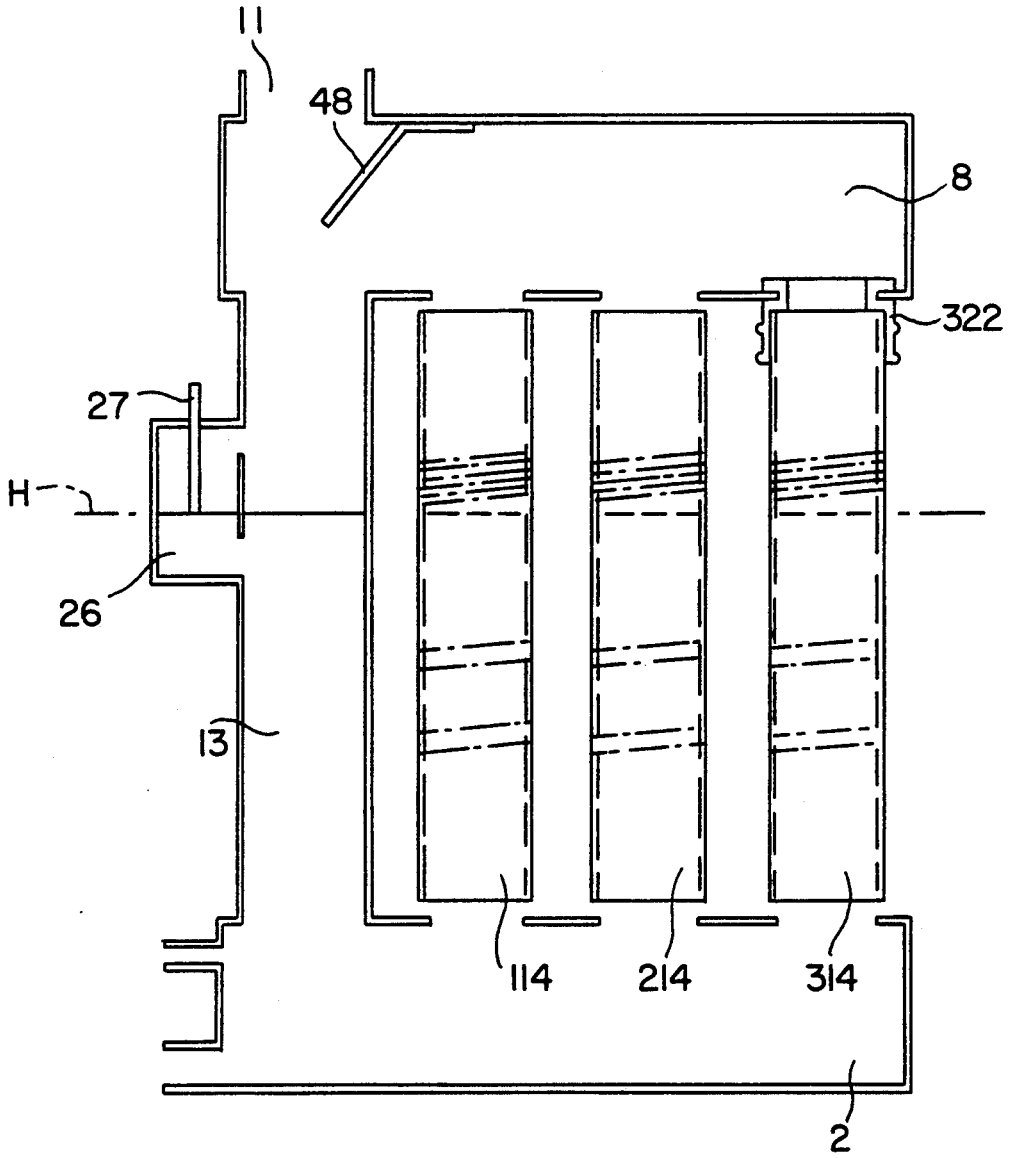
FIG. 5 shows a steam generator of the invention in an embodiment with multiple heating tubes.

In FIG. 5 a generator has been shown in an embodiment for delivering a higher steam flow. The generator comprises a single return tube 13, a single probe 26, but several heating tubes for example three tubes 114, 214 and 314. Each tube connects together the inner cavities of the lower duct 2 and of the upper duct 8 to which it is connected by flexible tubular connections such as connection 322, similar to connections 21 and 22 of FIG. 1. To simplify the drawings, only connection 322 has been shown. It is preferable to dispose the heating tubes 114, 214 and 314 in a row, in alignment: the steam flow in the upper duct 8 thus ensures an ordered flow of non vaporized water, and promotes its return to the return tube 13.

The present invention is not limited to the embodiments which have more explicitly been discussed, but includes the different variants and generalizations thereof contained within the scope of the following claims.

What is claimed is:

1. A steam generator comprising:

a lower transverse duct having a water intake orifice, an upper transverse duct with a steam discharge orifice, disposed above the lower duct, at least one heating riser tube with axial cavity a first end of which is sealingly connected to a first orifice of the lower duct, said first orifice of the lower duct disposed on the top of the lower duct, and a second end of which is sealingly connected to a first orifice of the upper duct, said first orifice of the upper duct disposed on the bottom of the upper duct, to ensure the passage of fluid between the lower duct and the upper duct, the heating tube having on its external face an electric resistance spirally wound about the heating tube substantially below the upper transverse duct, the electric resistance being connectable to a source of electric energy for heating the tube, a return tube, a first end of which is connected sealingly to a second corresponding orifice or the lower duct and the second end of which is connected sealingly to a second corresponding orifice of the upper duct, water level detection means for detecting the level of the water present in the generator, an electrovalve disposed upstream of the intake orifice of the lower duct in the water intake flow direction, the electrovalve closing and opening the duct for intake of water coming from a water supply source, a control assembly connected to the water level detection means for controlling the electrovalve for opening of the valve after said water level detection means has indicated that the water level in the heating tube is less than a predetermined low intermediate level in the heating tube, the control assembly adapted to cause closure of the valve when the water level in the heating tube is greater than a predetermined high intermediate level in the heating tube, so that the steam produced in the heating tube escapes directly into the upper transverse duct and the steam discharge orifice, without passing through the liquid layer, and so that the liquid phase water projected out of the heating tube into the upper transverse duct is separated from the steam and flows into the return tube.

2. The steam generator as claimed in claim 1, wherein the low intermediate level and the high intermediate level of the water in the heating tube are close to each other and are disposed in the vicinity of or slightly below the upper limit of the spiral resistance portion.

3. The steam generator as claimed in claim 2 wherein said water level detection means comprises a water level tube with axial cavity, a first end of which is sealingly connected to a third orifice of the lower duct and a second end of which is sealingly connected to a third orifice of the upper duct, said third tube containing a probe for measuring the level of water in said third tube, said probe coupled to said control assembly, wherein said probe transmits an electric signal to said control assembly responsive to contact with water.

4. The steam generator as claimed in claim 2 wherein said water level detection means comprises a probe for measuring the level of water when the level of the water reaches or exceeds an intermediate high level, said probe coupled to a valve control limiting circuit, said probe transmitting a first electric signal to said valve control limiting circuit responsive to the water rising above said intermediate high level, said probe transmitting a second electric signal to said valve control limiting circuit responsive to the water dropping below said intermediate high level, said valve control limiting circuit coupled to said electrovalve, said valve control limiting circuit transmitting an opening signal to said electrovalve following a delay, responsive to said second electric signal, said valve control limiting circuit transmitting a closing signal to said electrovalve, responsive to said first electric signal.

5. The steam generator as claimed in claim 1, wherein said heating tube further comprises a thermal safety probe connected to the control assembly and to an electric cut-off device for cutting off the power supply to the resistance when the temperature of the median zone of the heating tube exceeds a maximum predetermined temperature.

6. The steam generator as claimed in claim 1, further comprising several heating tubes connecting the same lower and upper transverse ducts together and disposed in an aligned row with said return tube.

7. A steam generator comprising:

a lower transverse duct having a water intake orifice, an upper transverse duct with a steam discharge orifice, disposed above the lower duct, at least one heating riser tube with axial cavity a first end of which is sealingly connected to a first corresponding orifice of the lower duct, and a second end of which is sealingly connected to a first corresponding orifice of the upper duct to ensure the passage of fluid between the lower duct and the upper duct, the heating tube having on its external face a spirally wound electric resistance welded to the heating tube, the electric resistance being connectable to a source of electric energy for heating the tube, a return tube, a first end of which is connected sealingly to a second corresponding orifice of the lower duct and the second end of which is connected sealingly to a second corresponding orifice of the upper duct, water level detection means for detecting the level of the water present in the generator, an electrovalve disposed upstream of the intake orifice of the lower duct int he water intake flow direction, the electrovalve closing and opening the duct for intake of water coming from a water supply source, a control assembly connected to the water level detection means for controlling the electrovalve for opening of the valve after said water level detection means has indicated that the water level in the heating tube is less than a predetermined low intermediate level in the heating tube, the control assembly causes closure of the valve when the water level in the heating tube is greater than a predetermined high intermediate level in the heating tube, so that the steam produced in the heating tube escapes directly into the upper transverse duct and the steam discharge orifice, without passing through the liquid layer, and so that the liquid phase water projected out of the heating tube into the upper transverse duct is separated from the steam and flows into the return tube, and said heating tube is connected to the upper duct and to the lower duct by flexible tubular connections without direct contact between the heating tube and the ducts, so that the heating tube is removable and the tubular connections provide soundproofing.

8. The steam generator as claimed in claim 7, wherein said return tube is a metal tube welded to the upper duct and to the lower duct, the whole forming a one-piece module.

9. The steam generator as claimed in claim 7, wherein each tubular connection is shaped so as to fit, by a first part, in the corresponding orifice of the upper duct or lower duct, a second portion of the tubular connection being shaped as a sleeve for fitting on the heating tube.

10. The steam generator as claimed in claim 9, wherein the first portion of said tubular connection comprises an external annular groove in which the edge of the corresponding orifice of the upper duct or lower duct is inserted.

11. A steam generator comprising:

a lower transverse duct having a water intake orifice, an upper transverse duct with a steam discharge orifice, disposed above the lower duct, at least one heating riser tube with axial cavity a first end of which is sealingly connected to a first corresponding orifice of the lower duct, and a second end of which is sealingly connected to a first corresponding orifice of the upper duct to ensure the passage of fluid between the lower duct and the upper duct, the heating tube having on its external face a spirally wound electric resistance welded to the heating tube, the electric resistance being connectable to a source of electric energy for heating the tube, a return tube, a first end of which is connected sealingly to a second corresponding orifice of the lower duct and the second end of which is connected sealingly to a second corresponding orifice of the upper duct, water level detection means for detecting the level of the water present in the generator, an electrovalve disposed upstream of the intake orifice of the lower duct in the water intake flow direction, the electrovalve closing and opening the duct for intake of water coming from a water supply source, a control assembly connected to the water level detection means for controlling the electrovalve for opening of the valve after said water level detection means has indicated that the water level in the heating tub is less than a predetermined low intermediate level in the heating tube, the control assembly causes closure of the valve when the water level in the heating tube is greater than a predetermined high intermediate level in the heating tube, sot hat the steam produced in the heating tube escapes directly into the upper transverse duct and the steam discharge orifice, without passing through the liquid layer, and so that the liquid phase water projected out of the heating tube into the upper transverse duct is separated from the steam and flows into the return tube, and the water level detection means comprise a third tube shunt connected between the upper duct and the lower duct, said third tube containing an axial resistive probe for measuring the level of the water in the third tube, the probe being disposed above the intermediate high level of the water so as to be in contact with the water when the level thereof reaches or exceeds said intermediate high level, so that the probe produces an electric detection signal when the water level becomes higher than the high intermediate level, the electric detection signal being applied to a valve control timing circuit which produces a signal after a delay following the termination of said electric detection signal to maintain the valve open for the intake of water at least until the detection signal appears again.

12. A cooking appliance including a steam generator comprising:

a lower transverse duct having a water intake orifice, an upper transverse duct with a steam discharge orifice, disposed above the lower duct, at least one heating riser tube with axial cavity a first end of which is sealingly connected to a first corresponding orifice of the lower duct, and a second end of which is sealingly connected to a first corresponding orifice of the upper duct to ensure the passage of fluid between the lower duct and the upper duct, the heating tube having on its external face an electric resistance spirally wound about the heating tube, the electric resistance being connectable to a source of electric energy for heating the tube, a return tube, a first end of which is connected sealingly to a second corresponding orifice of the lower duct and the second end of which is connected sealingly to a second corresponding orifice of the upper duct, water level detection means for detecting the level of the water present in the generator, an electrovalve is disposed upstream of the intake orifice of the lower duct in the water intake flow direction, the electrovalve closing and opening the duct for intake of water coming from a water supply source, a control assembly connected to the water level detection means for controlling the electrovalve for opening of the valve after said water level detection means has indicated that the water level in the heating tube is less than a predetermined low intermediate level in the heating tube, the control assembly adapted to cause closure of the valve when the water level in the heating tube is greater than a predetermined high intermediate level in the heating tube, so that the steam produced in the heating tube escapes directly into the upper transverse duct and the steam discharge orifice, without passing through the liquid layer, and so that the liquid phase water projected out of the heating tube into the upper transverse duct is separated from the steam and flows into the return tube.

13. A method of producing steam in a steam generator, wherein the steam is produced from water containing sediment, the method comprising the steps of:

introducing a predetermined amount of water into a lower duct and then to a vertical heating tube having on its external face an electric resistance spirally wound about the vertical heating tube, the vertical heating tube disposed completely above the lower duct and maintaining a substantially constant intermediate level of water int he vertical heating tube;

heating the vertical heating tube to produce steam and to produce ejected, non-vaporized water;

transferring the ejected, non-vaporized water from the top of the vertical heating tube to an upper duct disposed completely above the vertical heating tube;

transferring the ejected, non-vaporized water from the upper duct to the lower duct and then to the bottom of the vertical heating tube;

enabling the steam to exit the steam generator without passing through the water;

collecting the sediment in the water in the lower duct; and draining the sediment from the lower duct.

* * * * *